US005379204A

United States Patent [19]

Paterson

[11] Patent Number: 5,379,204

[45] Date of Patent: Jan. 3, 1995

[54] LUMINAIRE

[75] Inventor: George W. Paterson, Fife, Great Britain

[73] Assignee: Strand Lighting Ltd., Middlesex, United Kingdom

[21] Appl. No.: 976,478

[22] Filed: Nov. 16, 1992

[30] Foreign Application Priority Data

Mar. 31, 1992 [GB] United Kingdom ..... 9207085

[51] Int. Cl.[6] ..... F21V 21/00

[52] U.S. Cl. ..... 362/285; 362/289; 362/372; 362/425

[58] Field of Search ..... 362/285, 286, 288, 289, 362/270, 372, 425

[56] References Cited

U.S. PATENT DOCUMENTS 1,779,156 10/1930 Bamford ..... 362/289
4,145,141 3/1979 Noble ..... 362/285 X
4,232,359 11/1980 Leon et al. ..... 362/285 X
4,675,794 6/1987 Fink, Jr. et al. ..... 362/285 X
5,017,327 5/1991 Bamber ..... 362/289
5,086,379 2/1992 Denison et al. ..... 362/285 X
5,249,109 9/1993 Denison et al. ..... 362/285

*Primary Examiner*—Larry Jones
*Attorney, Agent, or Firm*—J. E. Brunton

[57] ABSTRACT

A luminaire has a captive stop slidable in a track in the lamp housing, the stop being engagable in bayonet fashion with a recessed track on the light source support housing insertable through the rear of the lamp housing. This permits the axial position of the light source to be set and maintained even when the light source is removed e.g. for replacement. To permit radial positioning of the light source, a pair of plates are constrained to slide in orthonal directions by pin and slot mechanisms, and a bolt is arranged both to displace the plates, and to lock the plates together at the desired radial position. A screwdriver is insertable through a hole in the lamp handle, to engage the bolt, and to give radial leverage in adjustment.

15 Claims, 8 Drawing Sheets

LUMINAIRE

BACKGROUND OF THE INVENTION

1. Field of the Invention

This invention relates to a mounting and/or positioning mechanism for a light source in a luminaire (i.e. amp unit), particularly, but not exclusively, for application in theatre, studio or other entertainment lighting.

2. Description of the Prior Art

In, for example, theatre lighting it is often desired to produce a shaped patch of light so as to give the impression of light through a window, for instance. For this purpose, a gate and shutter assembly is provided within the luminaire housing. The gate comprises a plate mounted transverse to the beam from the luminaire. A plurality of shutters (usually at least four) are provided each comprising a blade within the plane of the gate and a handle projecting out from the lamp housing through a slot. By manipulating the handle for each blade, the operator can swivel the blade angularly and also push the blade in and out of the aperture within the gate plate.

The gate plate is disposed between the light source (for example an incandescent bulb or lamp) and a projecting lens system, and these components are positioned such that the gate plate and shutters form a virtual object for the lens system, so that the light spot from the luminaire is the same shape as the shape defined between the shutter blades. For some theatrical effects, it is desirable that the intensity distribution within the spot of light is uniform, whereas for other effects a distribution with a higher intensity in the centre of the spot, falling off towards the edge may be preferred. The distribution of the light across the gate is dictated by the relative position of the light source to the parabolic or ellipsoidal reflector within which it is located, and in many lamps this position is variable by means of a positioning mechanism.

Incandescent lamps (and other types of light source) need replacing at fairly frequent intervals. They may need to be replaced whilst the luminaire is sited on the ceiling of a theatre or studio, for instance. To avoid having to remove and dismantle the entire housing and optical arrangement, the light source is often arranged to be removable through the rear of the lamp, together with its mounting block and power cable whilst the luminaire remains in situ. After changing the light source, the light source and its mounting block are then remounted in the luminaire.

In one known type of luminaire, the axial (i.e. longitudinal) focus position adjusting mechanism comprises a slot cut in the rear of the luminaire housing, and a threaded locking knob projecting through the slot inserted into the mounting of the light source. The slot is open at the rear end of the lamp housing. When it is desired to remove the light source, the knob is loosened and the mounting and knob together with the light source are withdrawn from the rear of the housing. The reverse process is carried out on reinserting the mounting. Then the focus is adjusted as desired by sliding the knob along the slot, and tightening the knob when the desired position is reached. This method of adjusting the focus is quick and easy to use, and is therefore often adopted. One example of such a construction is in the Lekolite (registered trademark) spotlight available from Strand Lighting Limited; another is in the 5/50 series spotlights available from Lee Colortran International.

However, this arrangement does have the disadvantage that when it is necessary to change the light source in use, the previous focus position is lost and the focus must be readjusted, which is inconvenient during a live performance and involves additional labour costs.

SUMMARY OF THE INVENTION

Accordingly, the present invention provides a luminaire assembly comprising a luminaire housing and a light source mounting member, further comprising means for adjusting the axial position of the light source mounting member to vary the focus of the lamp, characterised in that the focus adjusting means comprises a first portion captive within the lamp housing and a second portion engageable and disengageable from the first portion, one of the portions being axially moveable and lockable relative to the housing, the second portion on disengagement from the first being removable from the housing, to permit the light source to be replaced, and being insertable into the housing for engagement with the first portion.

The first portion therefore defines the focus position, allowing the lamp mounting to be removed, the lamp changed and the lamp mounting reinserted into the housing and re-engaged at the same defined focus position as before.

Preferably, the first portion is axially movable relative to the housing, for example sliding in a slot therein. Alternatively the second portion could be movable relative to the mounting member and the first could be a fixed abutment.

Preferably, the second portion is attachable to the first by a bayonet type mounting arrangement, thus allowing an operator to remove the light source without tools and, if necessary, using only one hand.

A further problem is that the radial position (i.e. the position in the plane normal to the optical access) of the light source can vary. This variance can be due, for example, to bending or misalignment of the mounting terminals for the light source or to, for example the filament not being centrally positioned due to manufacturing variations. Moreover, the position may vary with lamp temperature due to thermal expansion. Some luminaires therefore provide a radial light source position adjusting mechanism. In the above mentioned Lekolite (registered trademark) spotlight, a joystick control is provided at the rear of the lamp mounting block. In the above mentioned Lee Colortran International product, a thumb wheel is provided for alignment. In each of these cases, the thumb wheel or joystick knob is slackened off, the position is adjusted and then the wheel or knob is tightened. However, on tightening, the light source mounting block can be swivelled by the rotary tightening motion, so that the radial position of the light source changes from that which it was desired to lock the light source. Accordingly, it is difficult to accurately position the light source using these controls.

An alternative position adjusting mechanism is provided in the Altman 360Q luminaire. In this luminaire, a reference plate is provided at the rear of the lamp mounting block and the lamp is mounted on a moving plate at the front. Running between the two plates are three screws, defining a "three legged stool" arrangement. The three screws are separately adjusted with a screwdriver until the desired alignment of the forward plate is obtained, and then the two plates are locked together by a central locking screw. Accordingly, the operation of locking the position does not cause a significant change in the position. However, it is much more difficult to find the correct position in practice by manipulating three screws, and the need to use a screwdriver complicates the task further so that in practice it is much slower to adjust the lamp position using this type of mechanism. It is particularly important in live work in, for example, the theatre that the luminaire should be adjusted for the shortest possible time since many such luminaires may need adjusting in a rehearsal.

Accordingly, in a further aspect of the invention we provide a radial position adjusting mechanism for a luminaire assembly which comprises a pair of parts slideable relative to one another to cause radial movement of a light source connected to one, means for locking the members together at desired light source position, and means for constraining the motion of the parts so that on operation of the locking means they do not transmit twisting motion to the light source.

This arrangement allows the light source to be quickly positioned using a joystick type control, and then locked at the correct position without loss of accuracy using a rotational fastening such as a screw.

The sliding members may be a pair of plates, for example, each constrained to slide linearly in different directions (for example at 90 degrees to each other); the constraint may be achieved, for example, by providing slots in the plates engaging fixed pins (although it will be appreciated that other arrangements could be employed).

In another aspect, the invention provides a luminaire assembly including an axial position adjusting mechanism for a light source, the position adjusting mechanism including a rotatable locking member, further comprising a pivoting point spaced from the lamp housing, whereby a driving tool may be engaged with the locking member and the pivot and manipulated to vary the position of the locking member and the light source, and to lock the locking member at the desired position.

For example, the locking member may be a bolt or screw and the driving tool a screwdriver; in this case the pivot means may comprise a hole through which the screwdriver shank is insertable, provided for example in a handle extending rearwardly of the luminaire housing.

This arrangement avoids the need for a separate and expensive joystick or knob arrangement. Furthermore, joysticks or control knobs need to be relatively short to avoid accidental damage, whereas since the driving tool is removable it can be considerably longer. This allows, firstly, finer control over the position of the light source and, secondly, a greater spacing for the human hand from the considerable heat generated by the light source (which may be a 500 Watt-2 kilowatt incandescent lamp).

Another problem with the above described luminaires is that adjusting the axial position generally causes a shift in the radial position, and vice versa. Accordingly we provide, in a further aspect of the invention, a lamp position adjusting mechanism which can be removed and replaced without readjustment, and in which the axial position can be adjusted separately of the radial position.

Other aspects, embodiments and preferred features of the invention will be apparent from the following description and claims.

BRIEF DESCRIPTION OF THE DRAWINGS

The invention will now be illustrated, by way of example only, with reference to the accompanying drawings in which.

DESCRIPTION OF THE PREFERRED EMBODIMENTS

Figure 1:
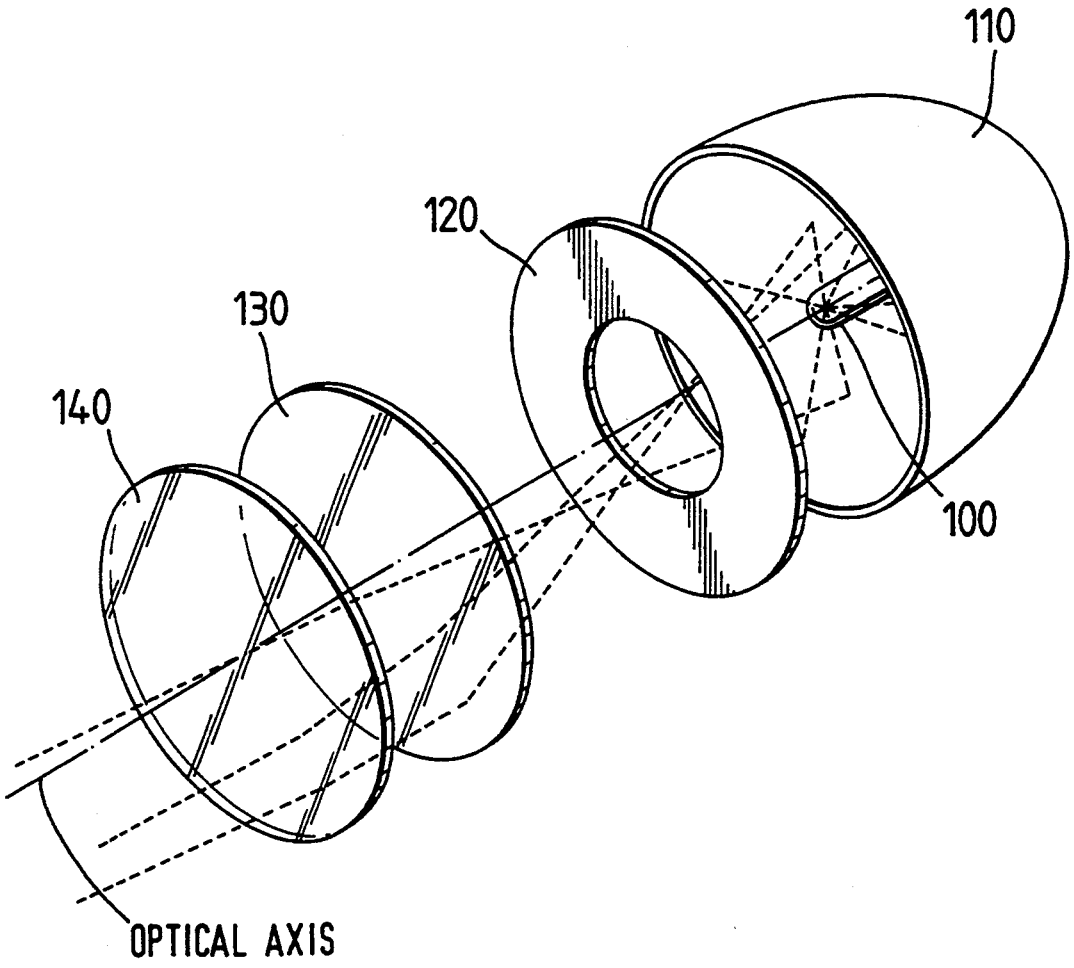
FIG. 1 illustrates schematically the optical arrangement of a luminaire assembly.

Referring to FIG. 1, the optical components of a luminaire for stage, studio or other entertainment use comprise a light source 100 (typically a 500 Watt-5 kilowatt incandescent lamp) located at one focus of an ellipsoidal reflector 110. Light from the light source 100 and reflector 110 is projected forwardly through a central circular aperture in a gate plate 120. The gate plate is positioned so that substantially all the beam passes through the central aperture. A projection lens system 130, 140 collects light passing through the gate plate 120 and provides a focussed beam with the edges of the aperture of the gate plate approximately in focus. The components 100–140 are housed within a luminaire housing (not shown) and the shutter blades are provided adjacent to the gate plate 120.

Figure 2:
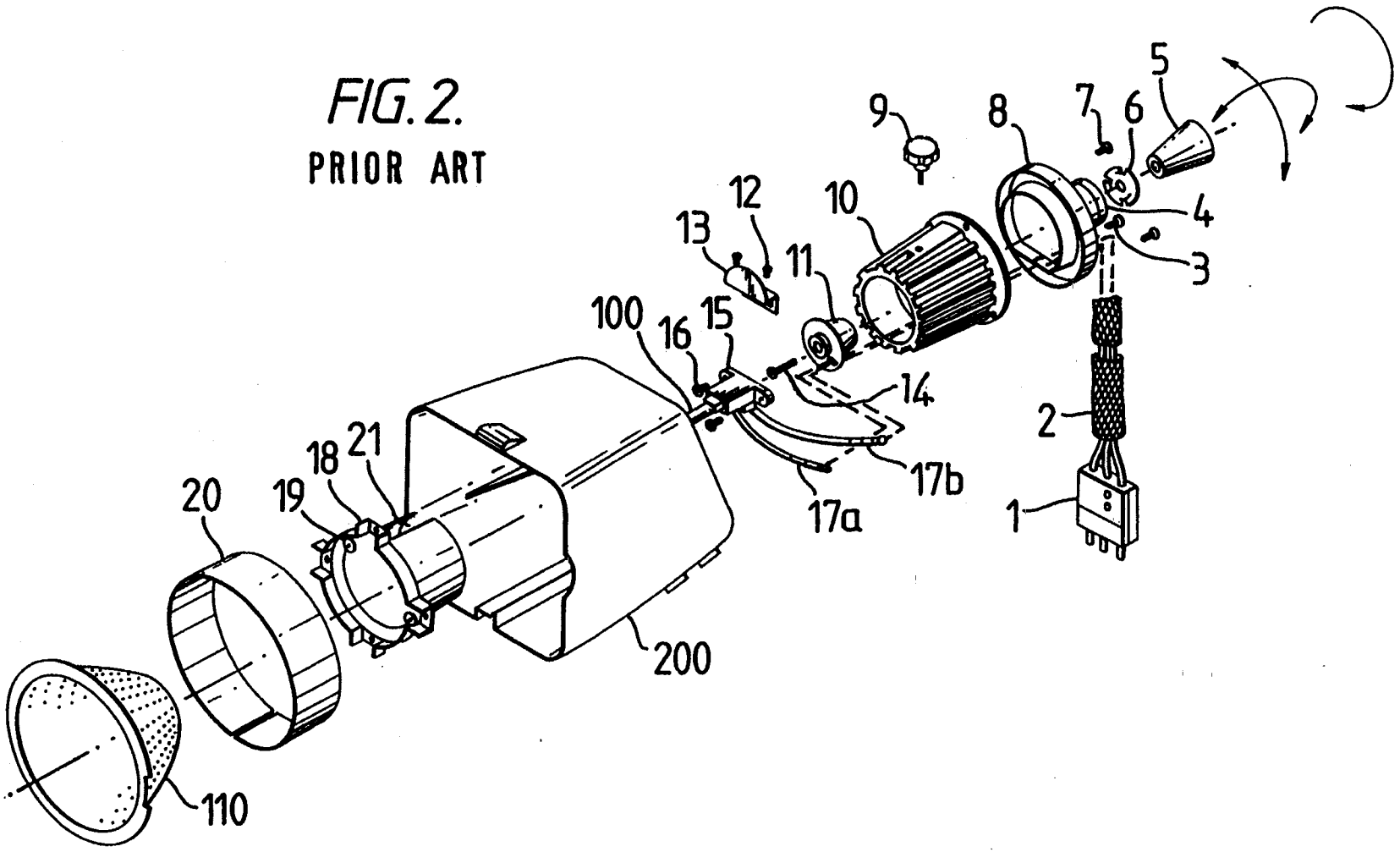
FIG. 2. PRIOR ART
FIG. 2 shows schematically the structure of a known lamp adjusting mechanism.

The arrangement of the gate plate and the shutter assembly, if present, may be as described in our UK Patent Application No. 9207048.1 filed on Mar. 31, 1992 (agents ref 3251601) incorporated herein by reference. Referring to FIG. 2, in one particular known structure (employed in the Strand Lekolite [registered trademark] spotlight available from Strand Lighting Limited, the present applicants) a rear lamp housing portion 200 receives the reflector 110 on a heat baffle 20. The reflector 110 is open at the rear thereof, to allow the insertion of the light source 100 to the focus of the reflector 110. The light source 100 is mountable in a socket 15 receiving a pair of leads 17*a*, 17*b* carrying power to the light source 100. A heat shield 13 is secured to the socket 15 by nuts 12 securing threaded connectors passing through aligned holes in the heat shield 13 and socket 15, and securing to a socket mounting block 11. Through the centre of the socket mounting block 11 a bolt 14 extends. In use, the socket mounting block 11 together with the socket 15 and light source 100 locate within a socket housing 10, and the bolt 14 projects through a hole in the rear of the socket housing 10, through a pair of washers 4, 6 (the washer 6 being a spring washer) and into a lamp centering knob 5 for manual manipulation.

At the rear of the socket housing 10, an electrical and thermal insulator ring 8 is provided mounting a handle for grasping the socket housing. A knob 9 carried on a threaded shank screws into a hole in the upper side of the socket housing 10.

Within the lamp housing 200, a casting 18 is provided secured to the housing 200 by a screw 19. The rear face of the housing 200 is open, so that the casting 18 is exposed. The diameter of the casting 18 is such as to receive the socket housing 10 in a relatively close fit, but permitting the socket housing 10 to be slid in and out of the casting 18 over the range of operating temperatures to which the lamp is subjected. Within the upper side of the casting 18 is an open slot 21 open at the rear of the casting 18, sufficiently wide to accept the threaded shank of the knob 9.

To remove and replace the light source 100, the knob 9 is slackened to allow the socket housing 10 to slide within the casting 21, and the socket housing 10 is slid out from the rear of the casting 21 and lamp housing 200. After the light source 100 has been changed, the socket housing 10 is reinserted into the casting 21 and the knob 9 retightened to secure it there.

To adjust the focus position of the light source 100 within the reflector 110, the knob 9 is slackened and the socket housing 10 is slid axially forward or backwards relative to the casting 18 and lamp housing 200 until the desired distribution is achieved, and then tightened to secure the light source 100 at that position.

To adjust the radial position of the light source 100, within the reflector 110, the knob 5 is rotated to slacken its engagement with the bolt 14. By moving the knob 5, the bolt 14 moves within the hole in the rear of the socket casting 10, changing the radial position of the light source 100. When the desired position is reached, the knob 5 is tightened on the bolt 14, against the action of the spring washer 6, to lock the spacer washer 4, bolt 14 and mounting block 11 at the desired position. It is during this tightening operation that the bolt 14, and hence the mounting block 11 and light source 100, are often twisted and so the light source 100 is displaced from the desired position.

Figure 3A:
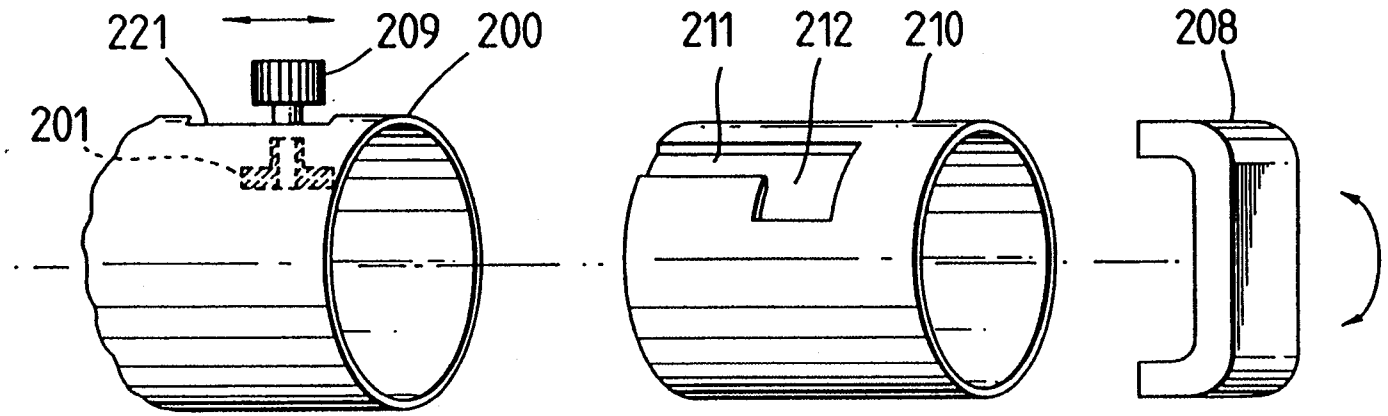
FIG. 3A is an exploded diagram showing the components of an axial light source position adjusting mechanism according to a first embodiment of the invention.

Referring to FIG. 3, the structure of the first embodiments of the invention will now be described. The rear part of the luminaire housing is provided with a slot 221 running axially, through which a threaded shank of a knob 209 passes. The other end of the threaded shank is received in a slideable stop member 201 including a threaded bore. By turning the knob 209 to draw the threaded shank into the threaded bore of the stop 201, the stop 201 can be locked against the luminaire housing 200 at a desired position along the slot 221; by loosening the knob 209 it can be slid to a desired position.

Figure 3B:
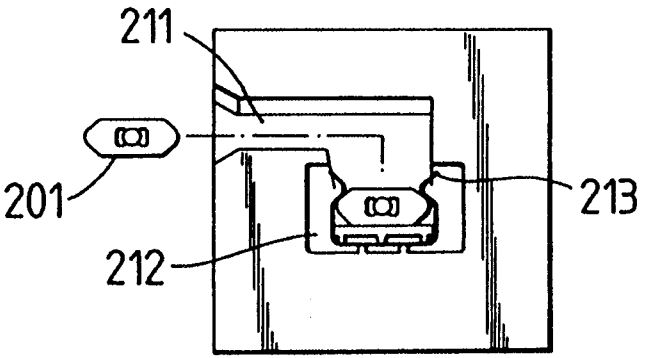
FIG. 3B is a detail of FIG. 3A.

The socket housing 210 includes a keyway 211 defining a recessed slot within which the stop 201 can locate. The outer diameter of the socket housing 210 fits fairly closely within the inner diameter of the lamp housing 200, so that the socket housing can only be inserted when the stop 201 lies within the keyway 211. At the end of the keyway 211 is a recess 212, at one side of the keyway 211, and of length and depth sufficient to accommodate the stop 201 as shown in FIG. 3*b*. Within the recess 212 a retention spring 213 is located so as to provide a resilient retention of the stop 201 within the recess 212 and to give a positive snap action when the stop 201 has been fully located in the recess 212.

In this embodiment, the arrangement of the light source 100, socket 15, cables 17*a*, 17*b*, etc. may be generally as shown in FIG. 2.

A handle 208 is provided at the rear of the socket housing 210, to allow the housing 210 to be manipulated by an operator.

In use, when it is desired to change the light source 100, the operator grasps the handle 208 and twists the handle to rotate the housing 210 relative to the stop 201 so that the step moves out of the recess 212, past the spring 213, and into the keyway 211. The operator then pulls the handle 208 backwardly, so as to move the socket housing 210 out of the luminaire housing 200, and the stop 201 sliding within the keyway 211 but remaining locked relative to the luminaire housing 200. The housing 210 together with the light source 100 is then withdrawn to permit the light source 100 to be changed.

To reinsert the socket housing 210, the operator aligns the keyway 211 with the stop 201 and pushes the handle 208 so that the housing 210 slides inwardly, the stop 201 sliding along the keyway 211 until the end of the keyway 211 is reached. At this point, the operator detects resistance to further sliding. He then applies a twist in the opposite sense (as shown, clockwise) to rotate the socket housing 210 to bring the stop 201 past the spring 213 into the recess 212.

Since the position of the stop 201 has remained locked relative to the slot 221 and luminaire housing 200, the axial position of the new light source 100 is exactly the same as was the position of the old light source prior to withdrawal of the socket housing 210. No further refocusing adjustment is necessary.

The proportions of the socket housing 210, within the luminaire body, are preferably such that the housing 210 is located and sliding parallel within the luminaire body before the light source 100 enters the aperture in the reflector, so that the light source 100 is guided through the aperture along the optical axis; this simplifies the task of reassembly.

To change the focus, the operator slackens the knob 209 to withdraw the threaded shank thereof somewhat out of the stop 201, and the knob 209, stop 201 and socket housing 210 (which is engaged with the stop 201 by the recess 212 and spring 213), and hence the light source 100 mounted thereon, can all be slid axially relative to the lamp housing 200 by moving the knob 209 along the slot 221 therein.

It will be seen that this arrangement has several advantages relative to that of FIG. 2. Firstly, the light source 100 can be withdrawn and changed and reinserted without needing to reset the axial position of the light source. Secondly, the socket housing 210 can be withdrawn in a single handed twist-pull operation which does not require any unscrewing operations, and is thus quicker and easier for operators.

Figure 4:
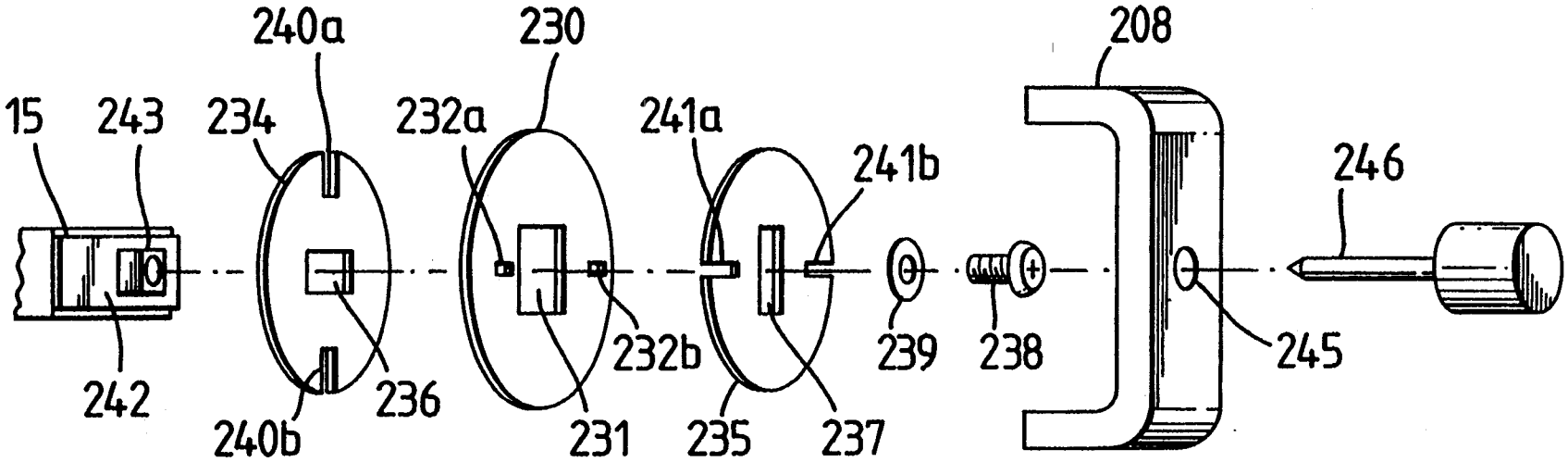
FIG. 4 is an exploded diagram showing schematically the structure of a radial light source position adjusting mechanism according to a second embodiment of the invention.
Figure 5:
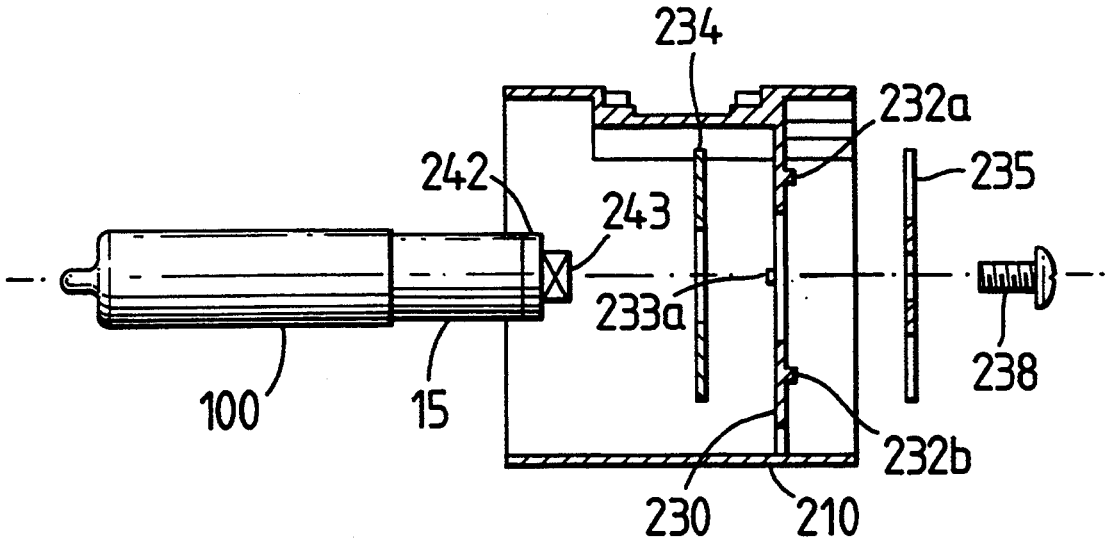
FIG. 5 is an exploded sectional view of the embodiment of FIG. 4.

Referring to FIGS. 4–6, the arrangement of a second embodiment of the invention will now be disclosed.

Referring to FIGS. 4 and 5, the socket housing 210 (not shown in FIG. 4) includes, towards the rear thereof, a fixed reference plate 230, normal to the optical axis of the lamp. The reference plate 230 includes a central square aperture 231. On the rear side of the plate 230, spaced at either side of the central aperture 231 defining a line through the centre thereof are a pair of raised pins 232*a*, 232*b*. At the forward side of the plate 230 are a similar pair of pins 233*a*, 233*b* defining a line, through the central aperture, inclined (e.g. at 90 degrees) to that defined by the first pair of pins, 232*a*, 232*b*.

A pair of sliding plates 234, 235, are received within the socket housing 210, one at either side of the fixed plate 230. Each of the sliding plates 234, 235 has a central elongate slot 236, 237, the long dimension of which corresponds to the side dimension of the central aperture 231 in the fixed plate 230 and the short dimension of which accommodates a bolt 238 which passes through a washer 239 and thence through the slots 237, 231, 236. Each of the plates 236, 237 carries a pair of slots 240*a*, 240*b*; 241*a*, 241*b*. Each pair of slots is symmetrical about the centres of the plates 236, 237 and each slot is dimensioned to accommodate a corresponding pin 233*a*,233*b*, 232*a*, 232*b* on the fixed plate 230 and is of a length such that when the three plates are axially aligned, the pins lie generally centrally within the length of the slots and so each sliding plate 234, 235 can be slid in either direction along the line defined by the respective pair c,f pins on the fixed plate 230. The line defined by the slots is inclined (e.g. normal) to the long dimension of the central elongate slot 236 or 237 for the respective plate. The pins and slots prevent the sliding plates 234, 235 from twisting or sliding in any other direction than that defined by the pins. The socket 15 carries at its rear surface a mounting plate 242 including a threaded bore provided in a square boss 243 projecting from the plate 242 through the slots 236, 237 and aperture 231 and receiving the end of the bolt 238.

The handle 208 includes a central aperture 245 through which a driving tool 246 (e.g. a screwdriver) is insertable; the aperture 245 is wider than the shank of the driving tool 246 to allow the shank to be pivoted within the aperture 245 with the head of the driving tool engaged with the head of the bolt 238, so that the aperture 245 acts as a pivot point for the driving tool 246. This arrangement makes it considerably easier to use the driving tool 246 to positionally shift the bolt 238 since a pivoting motion of the tool is easier to achieve for a user, and the head of the tool 246 is less likely to disengage from the head of the bolt 238.

Referring to FIG. 4, it will be apparent that (in the axis of the diagram) a vertical motion of the bolt 238 will cause it to slide within the aperture 237 moving the square boss 243, and light source mounting plate 242, but leaving the plate 235 unmoved (and retained against motion by the engagement of the slots 241 and pins 232). Because of the size of the aperture 231 in the reference plate 230, there will be no contact between the boss 243 and the reference plate 230. However, the boss will engage against the edges of the aperture 236 in the plate 234, and cause that plate to slide vertically with the slots 240 moving relative to the pins 233 on the reference plate 230, allowing the bolt to move vertically. Accordingly, the socket 15 and light source 100 will be displaced vertically with the bolt.

Likewise, a sideways motion of the bolt will leave the plate 234 unmoved, but will slide the plate 235 sideways and this permits the bolt 238 to shift the socket 15 and light source 100.

Likewise, when a force is applied to shift the bolt 238 in a direction intermediate to these two orthogonal axes, beth plates will slide to accommodate the motion.

However, when a twisting moment is applied to the bolt 238 (as occurs when the bolt is tightened using the driving tool 246) neither plate can twist; any rotational movement is precluded by the engagement of the slots 240, 241 and pins 232, 233, and also by the square boss 243 within the slots 236, 237. Accordingly, no movement of the socket 15 or light source 100 occurs on tightening of the bolt 238.

Figure 6A:
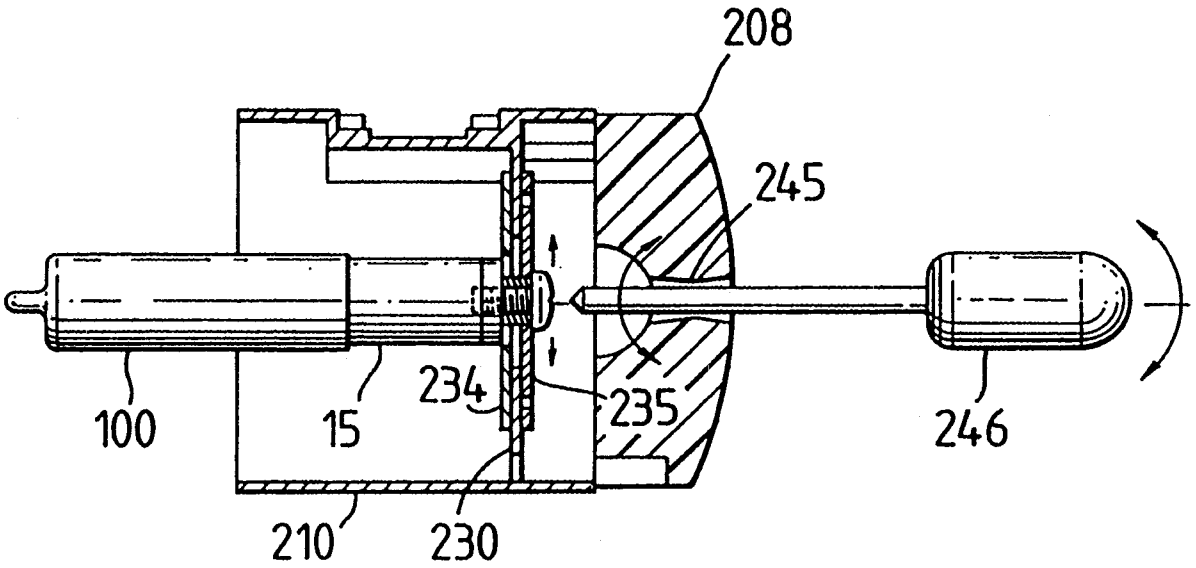
FIG. 6A is an assembled sectional view corresponding to FIG. 5.
Figure 6B:
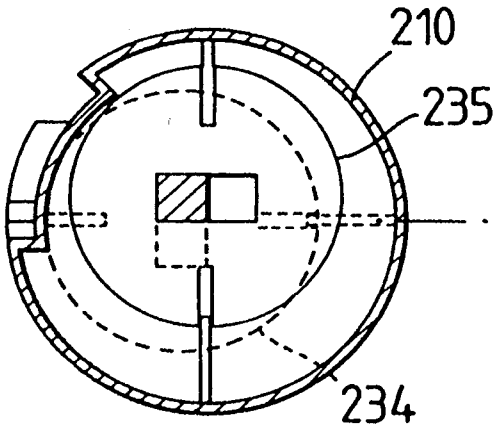
FIG. 6B is a sectional end elevation corresponding to FIG. 6A.

Referring to FIG. 6, in FIG. 6A the assembly is shown in section and in FIG. 6B, the engagement of the slots and pins which enables linear sliding but no twisting motion is shown.

It will be appreciated that the two plates 235, 234 do not need to be arranged to slide in orthogonal directions; it is merely necessary that they be arranged to slide in different directions. However, very large deviations from orthogonality make it less easy to adjust the lamp position since the force required to move the light source 100 will be different in different directions.

The central reference plate 230 need not, of course, comprise a circular plate as shown; an aperture is necessary to allow the passage of the bolt 238 and boss 243, and some features for engaging the plates 235 and 234 to constrain their movement to be linear are necessary.

The plates 230, 234, 235 need not be planar; they could be concave or convex, having conformal surfaces, and permitting sliding along arcuate tracks, so as to permit combined angular and radial adjustment.

Figure 7:
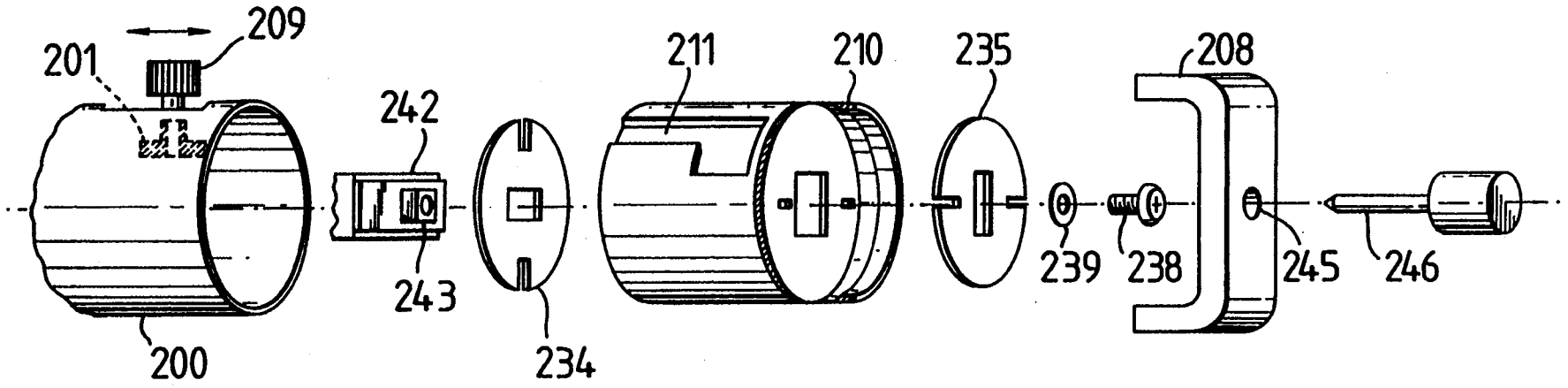
FIG. 7 is an exploded diagram of a third embodiment of the invention including the embodiments of FIGS. 3 and 4.

Referring to FIG. 7, in a third embodiment, the features of the first and second embodiments are combined as shown to provide a luminaire providing both axial and radial position adjustment for the light source. In this embodiment, the radial position adjustment is likewise not disturbed by removing the light source 100 from the lamp housing.

Figures 8, 9:
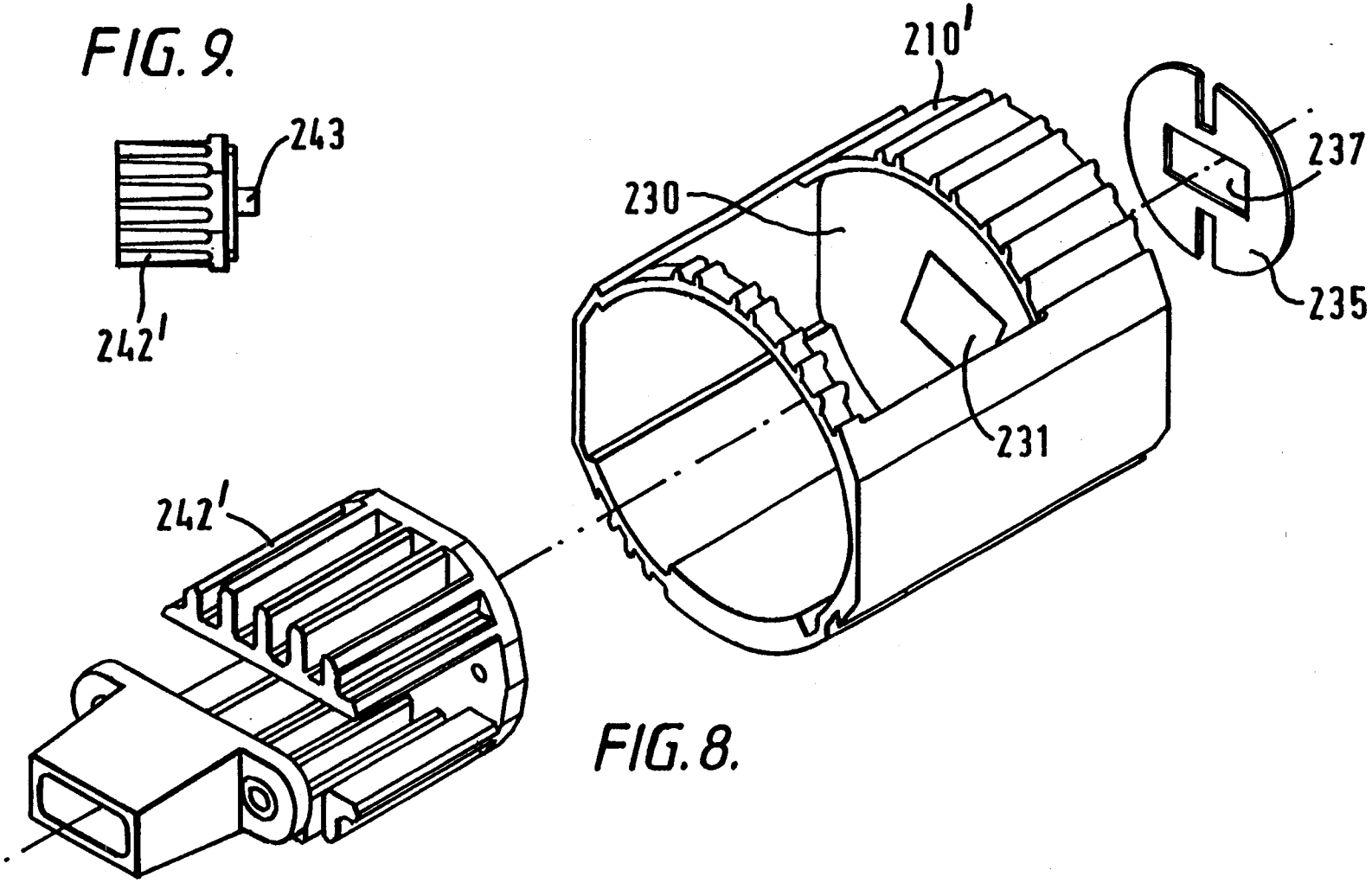
FIG. 8 is an exploded diagram of a fourth embodiment of the invention.
FIG. 9 is a plan view of part of the embodiment shown in FIG. 8 en a reduced scale to that of FIG. 8.

Turning now to FIGS. 8 and 9, the fourth embodiment is an adaptation of the second embodiment shown in FIGS. 4 to 6, and thus corresponding features are correspondingly labelled. The shape of the housing 210' and lamp mounting 242! have, however, been changed relative to that of the second embodiment, the housing 210' and mounting 242' having a knurled external configuration. As can be seen in FIG. 9, the modified lamp mounting 242' still retains the square boss 243. Turning now particularly to FIG. 8, in the fourth embodiment the sliding plate 234 is omitted, as are the pins 233*a* and 233*b* on the fixed plate 230. When the lamp mounting 242' is inserted in the housing 210', rotation of the housing is precluded by the square boss 243 entering firstly the rectangular central aperture 231 formed in the fixed plate 230, and subsequently the narrower elongate slot 237 formed in the plate 235. The fixed plate 230 carries pins 232*a*, 232*b* as in the second embodiment, these not being apparent in FIG. 8. As in the second embodiment the pins 232*a*, 232*b* locate in the opposed slots formed on the periphery of the plate 235.

By way of example only, in the above embodiments the lamp socket 15 may be a standard component as already employed in the above described Lekolite (registered trade mark) luminaire; the reference plate 230 and socket housing 210 may comprise an aluminium pressure die casting, as may the mounting plate 252 and bore 253; the sliding plates 234, 235 may comprise mild steel pressings; the handle 208 may comprise a high temperature thermoplastic material molding and the other components are conventional. This structure is cheap to manufacture, easy to use and provides only a single screw fastening and a single knob.

Other constructions are, of course, equally possible.

The invention could be used in optical applications other than theatre or entertainment lighting.

What I claim is:

1. A luminaire comprising means for mounting a light source, and means for directing the beam therefrom along an optical axis of the luminaire in which the means for mounting the light source is removable, and further comprising means for adjusting the position along the optical axis of the light source relative to the adjusting means, wherein the position adjusting means comprises an abutment provided on the luminaire and an engaging feature provided on the mounting means, the engagement between the two defining the position at which the light source mounting means is axially located when inserted into the lamp, the relative axial position of the abutment or feature being variable.

2. A luminaire comprising means for mounting a light source, and means for directing the beam therefrom along an optical axis of the luminaire in which the means for mounting the light source is removable, and further comprising means for adjusting the position along the optical axis of the light source relative to the adjusting means, wherein the position adjusting means comprises an abutment provided on the luminaire and an engaging feature provided on the mounting means, the engagement between the two defining the position at which the light source mounting means is axially located when inserted into the lamp, the relative axial position of the abutment or feature being variable, said abutment comprising a stop member slidable along a path in the lamp extending axially, and means for locking the stop member at a desired position along the path, and in which the light source mounting means comprises a feature engaging with the stop member.

3. A luminaire according to claim 2, in which the feature comprises a path on the light source supporting means, extending axially, along which the stop member is slidable to a predetermined point.

4. A luminaire according to claim 3, in which the feature further comprises resilient means for resiliently retaining the stop member at the predetermined point.

5. A luminaire according to claim 3 in which the stop member extends inwardly of the lamp and the feature comprises a recessed track along the light source mounting means.

6. A lamp positioning mechanism in which the lamp can be removed and replaced to the same axial position without requiring axial readjustment, and in which the axial position can be adjusted separately of the radial position.

7. A luminaire comprising means for mounting a light source, an optical system, and radial position adjusting means for moving the mounting means to displace the light source, relative to the optical system, radially of the optical axis of the luminaire, in which the radial position adjusting means comprise a pair of members, a first being slidable relative to a second, and means for causing the first to slide relative to the second, further comprising means for preventing the first from twisting relative to the second.

8. A luminaire comprising a light source support and a radial position adjuster for the light source support which comprises at least two members, means for applying a radial force to a first of the two members to displace it relative to the second of the two members, and means for applying an axial force to lock the first and second members together at a desired displacement, wherein the means for applying an axial force is a screwed fastening and there are provided means for preventing the first and second members from rotating on tightening of the screwed fastening.

9. A luminaire according to claim 7 or claim 8, in which one of said members is a fixed member and at least one of the other members is a moving member, the luminaire being such that where there are two moving members, the luminaire includes means for constraining each of the moving members to move in a different radial direction relative to the fixed member.

10. A luminaire according to claim 8, in which at least one member comprises a sliding plate.

11. A luminaire according to claim 9, in which the constraining means comprise a pin and slot mechanism acting between the fixed member and each moving member.

12. A luminaire assembly including a radial position adjusting mechanism for a light source, the position adjusting mechanism including a rotatable locking member, in which the locking member acts also to transmit radial force to the position adjusting mechanism to displace the light source position, further comprising means defining a pivoting point spaced from the lamp housing, whereby a driving tool may be engaged with the locking member via the pivoting point and manipulated to vary the position of the locking member so as to vary the light source position, and to lock the locking member at the desired position.

13. A luminaire assembly according to claim 12, in which the means defining the pivoting point comprises a handle including an aperture defining the pivoting point.

14. A luminaire including a support for a light source, the support being insertable and removable through the rear of the luminaire, in which the support and the housing of the luminaire include conforming features permitting the support to be slid into the housing axially thereof, and then twisted to lock the support relative thereto.

15. A luminaire comprising a reflector including an aperture through which a light source is insertable, and a removable light source support, in which the light source support and luminaire are so constructed that on replacement of the light source support within the luminaire the light source is aligned with and guided through said aperture.

* * * * *